United States Patent [19]

Suzuki

[11] Patent Number: 4,730,088

[45] Date of Patent: Mar. 8, 1988

[54] TRANSMISSION LINE

[75] Inventor: Hirosuke Suzuki, Tokorozawa, Japan

[73] Assignee: Junkosha Co., Ltd., Japan

[21] Appl. No.: 923,820

[22] Filed: Oct. 27, 1986

[30] Foreign Application Priority Data

Nov. 15, 1985 [JP] Japan ..... 60-256231

[51] Int. Cl.[4] ..... H01B 11/00; H01B 7/08

[52] U.S. Cl. ..... 174/102 R; 174/28; 174/110 F; 174/117 F

[58] Field of Search ..... 174/27, 28, 29, 102 R, 174/102 D, 110 F, 117 F

[56] References Cited

U.S. PATENT DOCUMENTS

| | | | |
|---|---|---|---|
| 2,805,276 | 9/1957 | Weitzel | 174/110 F |
| 3,639,674 | 2/1972 | Stier | 174/102 R X |
| 4,104,481 | 8/1978 | Wilkenloh et al. | 174/102 R X |
| 4,368,350 | 1/1983 | Perelman | 174/110 F X |
| 4,443,657 | 4/1984 | Hill et al. | 174/110 F X |
| 4,645,868 | 2/1987 | Suzuki | 174/117 F |
| 4,649,228 | 3/1987 | Suzuki | 174/117 F X |

FOREIGN PATENT DOCUMENTS 176132 10/1982 Japan .

*Primary Examiner*—Morris H. Nimmo
*Attorney, Agent, or Firm*—Mortenson & Uebler

[57] ABSTRACT

A high speed electrical transmission line is provided comprising a signal conductor having an open cell, continuously porous, polymeric insulating material surrounding the conductor, the insulating material having a plurality of openings fused therein, the walls of the openings being solid, fused polymer which provide compressive strength for the otherwise highly compressible porous insulating material. The preferred polymer is expanded, porous polytetrafluoroethylene. The openings may be formed by a laser or by other means.

9 Claims, 5 Drawing Figures

TRANSMISSION LINE

BACKGROUND OF THE INVENTION

The present invention relates to a transmission line for high-speed electrical signal transmission. This type of transmission line is desired to enable signal transmission to be effected at increased speed with enhanced stability so as to meet the requirements for high-speed electronic computers.

It is generally recommended to employ porous substances as dielectric materials for increasing the speed in signal transmission effected by electronic devices such as transmission lines. Among such porous substances is oriented, porous, expanded polytetrafluoroethylene, produced by the method disclosed in U.S. Pat. No. 3,953,566. This material is stable both physically and chemically and has excellent electrical characteristics.

To further improve the electrical characteristics of such porous substance, the present inventor has previously invented a sheet-shaped resin material and filed an application for a patent (see the specification of Japanese Patent Laid-Open No. 176132/1982). This prior invention is arranged such that a porous sheet material is provided with a multiplicity of through-holes in order to further increase the porosity, thereby lowering the permittivity of the material. This prior art has, however, the disadvantage in that, when a porous sheet material of open-cell type is employed, the material collapses easily and is unstable. Therefore, a transmission line formed using such material has unstable characteristics, disadvantageously.

Accordingly, it is an object of the present invention to provide a high-speed transmission line having a dielectric which is not readily collapsed and has a lowered permittivity.

SUMMARY OF THE INVENTION

An electrical transmission line is provided comprising a signal conductor having a porous polymeric insulating material surrounding the conductor, the insulating material having at least one opening therein having a wall, the polymeric material at and near the wall being solid, fused polymeric material, whereby the opening provides compressive strength for the otherwise highly compressible, porous material. The transmission line preferably has a plurality of openings. In one embodiment, the transmission line is a round cable and the opening is a groove oriented helically about the conductor. In another embodiment, a plurality of openings are oriented radially outwardly from the conductor. The preferred insulating material is porous, expanded, unsintered polytetrafluoroethylene. The insulating material may be porous, expanded, amorphously locked polytetrafluoroethylene, or other porous dielectric. The transmission line may have an outer shielding conductor around the insulating material to form a coaxial cable. In a further embodiment, the transmission line has a plurality of conductors oriented substantially in parallel between sheets of the insulating material to form a flat multiconductor cable.

Figure 1:
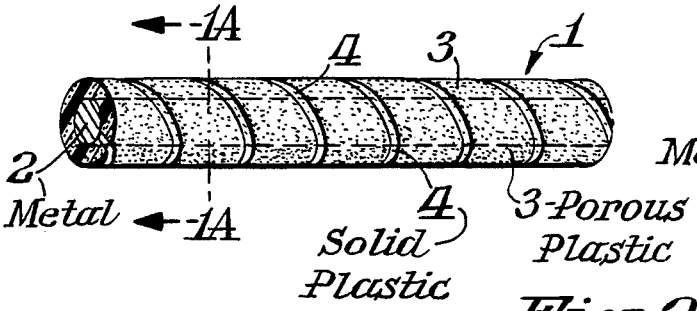
FIG. 1 is a perspective view, partly in cross-section, of a single conductor transmission line according to the invention.

DETAILED DESCRIPTION OF THE INVENTION AND PREFERRED EMBODIMENTS WITH REFERENCE TO THE DRAWINGS

A high speed electrical transmission line is provided comprising a signal conductor having an open cell, continuously porous, polymeric insulating material surrounding the conductor, the insulating material having a plurality of openings fused therein, the walls of the openings being solid, fused polymer which provide compressive strength for the otherwise highly compressible porous insulating material. The preferred polymer is expanded, porous polytetrafluoroethylene. The openings may be formed by a laser or by other means.

The present inventor, after exhaustive study of the defects of the prior art, reached the following conclusion: If an open-cell type porous dielectric is disposed on the outer peripheral portion of a signal conductor and a fused opening is provided in this porous dielectric by means of heat rays, light rays, particle rays (such as proton, electron, ion or plasma), or a high-temperature rod-like member, the wall portion of the opening is solidified and has increased density as a result of the fusion to form a support portion. Therefore, if such fused openings are distributively disposed at various places over the surface of the open-cell porous dielectric, the openings function as support-like reinforcing members, with the result that a portion of the porous dielectric which is present between such fused openings does not collapse and, at the same time, through-bores are defined by the fused openings. Thus, it is possible to obtain a dielectric which is not readily compressible and has a lowered permittivity, which means that a transmission line having excellent high-speed transmission characteristics can be obtained.

The present invention basically provides a transmission line comprising at least one signal conductor, an open-cell type porous dielectric surrounding the signal conductor, and at least one fused opening provided in the porous dielectric.

In this arrangement, if an oriented porous, expanded polytetrafluoroethylene is employed as an open-cell type porous dielectric, it is possible to provide, in a conventional manner, a transmission line having high reliability, because such resin is stable and has excellent physical properties. Further, if an unsintered material is employed as the oriented porous polytetrafluoroethylene, the heat applied during the formation of the fused openings causes the material thereat to be sintered. Therefore, the need for a separate sintering step may, if desired, be eliminated, and it is then possible to reduce the production cost.

According to the present invention, an open-cell type porous dielectric is provided on the outer periphery of a signal conductor, and at least one fused opening is provided in this dielectric. Therefore, the fused opening enables formation of a support-like portion which is solidified and increased in density, and also permits retention of shape to be effected. Thus, it is possible to obtain a transmission line which is stable and has a lowered permittivity and which enables high-speed transmission of electrical signals.

A detailed description of the invention and preferred embodiments is best provided with reference to the drawings wherein FIG. 1 is a perspective view of an end portion of a transmission line 1 in accordance with one embodiment of the present invention.

The transmission line 1 comprises a signal conductor 2 around which is helically wound, on the outer periphery thereof, a plurality of layers of film-like, open-cell type, porous dielectric 3 made of, e.g., an unsintered oriented porous polytetrafluoroethylene tape produced by the method disclosed in U.S. Pat. No. 3,953,566, and the outer periphery of the dielectric 3 is irradiated with any desired laser beam to provide a spiral and continuous fused opening or groove 4. During this irradiation step, the dielectric 3 is thermowelded to the signal conductor 2 so as to be rigidly secured thereto, and the dielectric 3 is sintered.

The wall portion of the fused opening 4 is solidified and increased in density by the fusion, resulting in the formation of a spiral support. The outer periphery of this dielectric 3 may be further provided with a solid dielectric layer or sheath, whereby radial stress is satisfactory supported by the solid and high-density wall portion of groove 4, so that substantially no stress acts on the open-cell porous dielectric 3 present between two adjacent portions of the fused opening 4, and it is therefore possible to obtain a transmission line in which the porous polytetrafluoroethylene insulation is not readily compressed. It should be noted that, when the grooves of the fused opening 4 are pitched so that adjacent spirals are closer together, a transmission line is formed in which the porous insulation is not readily collapsed even without a protective layer or sheath. In addition, the fused opening 4 is formed in such a manner that one portion of the porous resin which is initially present thereat thermally shrinks and moves sideways to form a high-density wall, and another portion of the resin is thermally decomposed to form an opening to the conductor therein. Therefore, it is possible to improve the mechanical characteristics and lower the permittivity of the cable, so that a low-loss and high-speed transmission line can be obtained.

Figure 1A:
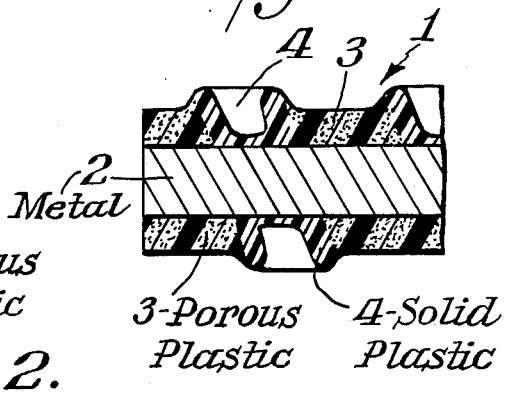
FIG. 1A is a cross-sectional view taken along line 1A—1A of FIG. 1.

FIG. 1A is taken along line 1A—1A of FIG. 1. Therein, groove 4 is shown extending to a depth only part of the distance into the insulation from the outer surface of the insulation to the conductor. This groove could extend all the way through to the conductor.

Figure 2:
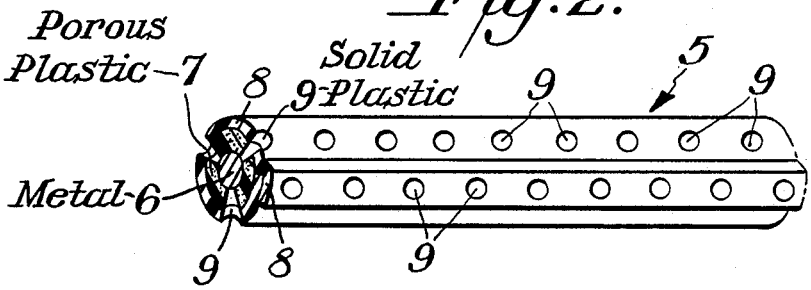
FIG. 2 is a perspective view of an alternate embodiment of a single conductor transmission line according to the invention.

FIG. 2 is a perspective view of an end portion of a transmission line 5 in accordance with another embodiment of the present invention.

In this case, polytetrafluoroethylene is extruded onto the outer periphery of a signal conductor 6 in such a manner that both the signal conductor 6 and the extruded resin are taken off at a higher speed than the extrusion speed, thereby stretching the resin sheath, whereby an open-cell porous dielectric 7 is formed on the outer periphery of the signal conductor 6. Then, a solid plastic sheath 8 is longitudinally provided on the outer periphery of the dielectric 7, and the outer peripher of the sheath 8 is irradiated with a laser beam to provide a multiplicity of radially oriented fused openings 9.

During this fusion process, the sheath 8 is rigidly secured to the dielectric 7 by thermowelding, while the dielectric 7 is thermowelded to the signal conductor 6, and the dielectric 7 is sintered at the walls of openings 9. It is therefore possible to reduce the number of required process steps and eliminate the need for an overall sintering step. As a consequence, there is no substantial thermal shrinkage of the resin material, and the dimensional stability of the product is improved. Openings 9 are shown extending through the insulation to the conductor.

Figure 3:
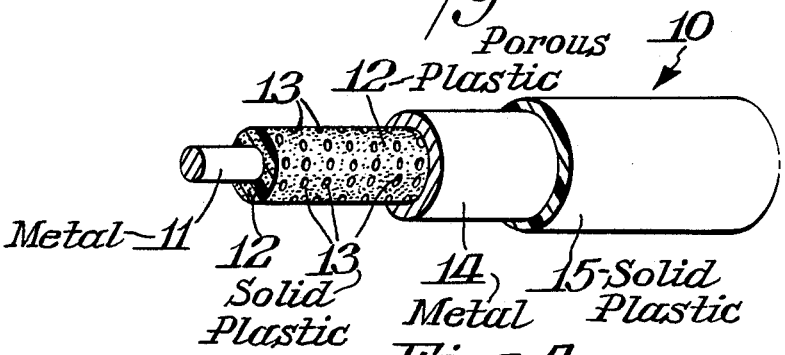
FIG. 3 is a perspective view, partly in cross-section, of a coaxial cable employing the principles of the invention.

FIG. 3 is a perspective view of an end portion of a coaxial transmission line 10 in accordance with still another embodiment of the present invention.

In the case of the coaxial transmission line 10, a signal conductor 11 made from a silver-plated copper wire having a diameter of 0.16 mm is helically wound on the outer periphery thereof with an oriented porous polytetrafluoroethylene tape which has been streteched to 3 times its original length and amorphously locked, providing an open-cell type porous dielectric 12 over conductor 11, this construction having an outer diameter of 0.89 mm. The dielectric 12 is provided with a multiplicity of radially oriented fused openings 13 at regular spacings of 0.3 mm by means of a laser having a beam diameter of 0.2 mm, and the outer periphery of this dielectric 12 is provided with an outer shielding conductor 14, preferably a braided shielding conductor, and a solid protective plastic sheath 15.

The transmission characteristics of this coaxial transmission line 10 were measured with the result that it was possible to obtain a characteristic impedance of 95 ohms, a 10–90% pulse rise time of 35 microseconds and a transmission delay of 3.60 nanoseconds/meter.

Accordingly, the relative permittivity of the porous dielectric 12 provided with the openings 13 of the coaxial transmission line 10 in accordance with this embodiment is equivalent to 1.17. This relative permittivity has been reduced to 86.7% of the relative permittivity of 1.35 of an otherwise identical cable except that no openings 13 are provided.

For a relative permittivity of 1.35 measured in the case in which no openings 13 are provided, the outer diameter of the dielectric 12, employing the same signal line 11, must be set at 1.01 mm in order to obtain a transmission line having a charasteristic impedance of 95 ohms. In contrast to this, provision of the opening 13 in accordance with the present invention enables the outer diameter of the dielectric 12 to be reduced to 0.89 mm, i.e., by about 12%; therefore, the present invention can result in increased packing density of such transmission lines.

Figure 4:
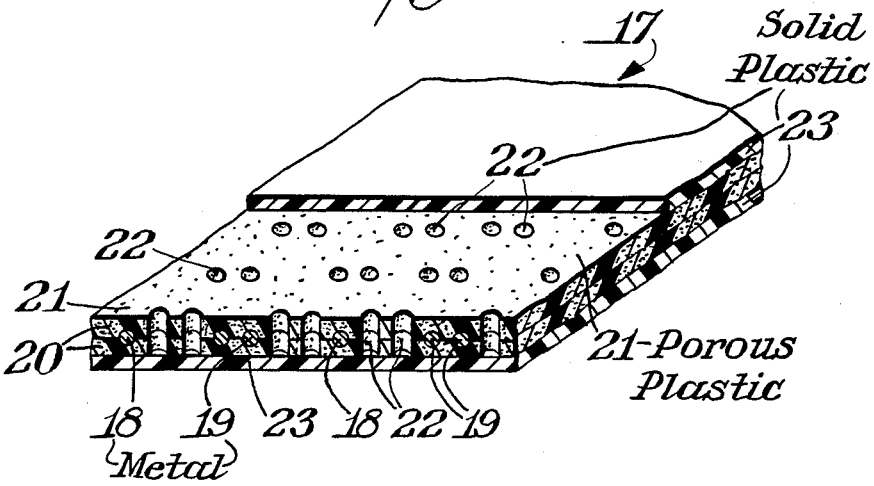
FIG. 4 is a fragmentary cutaway view of a multiconductor flat cable, partly in cross-section, according to the invention.

FIG. 4 is a fragmentary cutaway view of a further embodiment of the present invention in which the invention is applied to a strip line flat cable.

This transmission line 17 is formed in such a manner that signal conductors 18 and ground conductors 19, which are alternately disposed in parallel to each other, are sandwiched by two open-cell type porous dielectrics 21 which are sheets of unsintered, oriented, porous, expanded polytetrafluoroethylene films 20, and a multiplicity of fused openings 22 are provided between the signal conductors 18 and the grounding conductors 19, thereby securing the films 20 to each other in one unit by thermowelding. The openings 22 may be provided by means, for example, of press-fitting of a high-temperature heating rod, a laser beam, heat rays or particle rays.

Thereafter, a solid polytetrafluoroethylene film 23 is provided on each side of the oriented porous polytetrafluoroethylene flat cable 20 provided with a multiplicity of fused openings 22 and thermally welded together in one unit, thus forming a strip line.

During the thermowelding step, the open-cell type porous dielectric 21 is sintered.

In the case of the transmission line 17 in accordance with this embodiment also the porous dielectric 21 surrounding the signal conductors 18 is provided with a multiplicity of openings 22, and the wall portion of each of these openings 22 defines a supporting pillar which is solidified and has increased density, so that the dielectric 21 is not readily collapsed and has high compressive strength.

As has been described above, the transmission line according to the present invention comprises a signal conductor, an open-cell type porous dielectric surrounding the signal conductor and at least one opening provided in the porous dielectric. It is therefore possible to obtain several advantages as follows:

(1) The fused opening provides a reinforcing support which is solid and has increased density. As a result, the porous dielectric is not readily compressed and a stable, reduced permittivity is obtained, so that it is possible to provide a stable high-speed transmission line.

(2) Provision of the fused opening enables the permittivity to be further lowered and the loss angle to be decreased, so that it is possible to further increase the signal transmission speed. In addition, in a flat multiconductor cable, the spacing between each pair of adjacent conductors can be reduced to obtain a predetermined characteristic impedance, which means that it is possible to increase the packing density of the transmission line.

(3) When an unsintered expanded polytetrafluoroethylene material is employed as the porous dielectric, the material is sintered to an appropriate extent during the process of forming the fused opening. Therefore, it may become unnecessary to carry out any overall sintering step for obtaining a finished product, so that the production costs can be reduced. Additionally, because there is no shrinkage of the dielectric which would otherwise occur during the sintering step, it is possible to obtain excellent dimensional stability in the finished product.

It should be noted that the present invention is not necessarily limited to the above-described embodiments, and various changes and modifications may be imparted thereto without departing from the idea of the present invention. For example, the above-described embodiments may be combined together as desired, or fused openings may be provided by any desired means. Further, the fused openings may be formed in such a manner that they do not extend through the entire thickness of the dielectric, but they may have any desired depth.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. An electrical transmission line comprising a signal conductor, a porous polymeric insulating material surrounding said conductor, said insulating material having at least one opening therein having a wall, the polymeric material at and near said wall being solid, fused polymeric material, whereby said opening provides compressive strength for the otherwise highly compressible, porous material.

2. The transmission line of claim 1 having a plurality of said openings.

3. The transmission line of claim 1 wherein said opening is a groove oriented helically about said conductor.

4. The transmission line of claim 2 wherein said openings are oriented radially outwardly from said conductor.

5. The transmission line of claim 1 wherein said insulating material is porous, expanded, unsintered polytetrafluoroethylene.

6. The transmission line of claim 1 wherein said insulating material is porous, expanded, amorphously locked polytetrafluoroethylene.

7. The transmission line of claim 1 in the form of a round cable.

8. The transmission line of claim 7 having an outer conductor around said insulating material to form a coaxial cable.

9. The transmission line of claim 2 having a plurality of conductors oriented substantially in parallel between sheets of said insulating material to form a flat cable.

* * * * *